US005768799A

United States Patent [19]

Delaunay et al.

[11] Patent Number: 5,768,799

[45] Date of Patent: Jun. 23, 1998

[54] PROCESS AND APPARATUS FOR COATING METAL SHEETS

[75] Inventors: Didier Delaunay, Breuillet; Hugues Amaury Jean Vialla, Paris, both of France

[73] Assignee: Stein Heurtey, Ris-Orangis, France

[21] Appl. No.: 646,222

[22] Filed: May 6, 1996

[30] Foreign Application Priority Data

May 23, 1995 [FR] France ..... 95 06141

[51] Int. Cl.[6] ..... F26B 3/34

[52] U.S. Cl. ..... 34/247; 34/68; 34/443; 34/444; 34/493

[58] Field of Search ..... 34/247, 68, 72, 34/493, 443, 444

[56] References Cited

U.S. PATENT DOCUMENTS 4,370,357 1/1983 Swartz .
4,849,598 7/1989 Nozaki et al. .
5,357,687 10/1994 Swain .

FOREIGN PATENT DOCUMENTS

WO 92/14979 9/1992 WIPO .

*Primary Examiner*—Henry A. Bennett
*Assistant Examiner*—Pamela A. Wilson
*Attorney, Agent, or Firm*—Pollock, Vande Sande & Priddy

[57] ABSTRACT

A process for the protective or decorative coating of a continuously moving metal sheet, in which the sheet, after having received its coating, is heated by electromagnetic induction in a tunnel oven in order to evaporate the solvents and to cure the coating. The solvents are continuously extracted from the chamber of the oven, wherein a gas at a temperature greater than the dew point of the solvents is injected into the oven and which is gastight and thermally insulated in order to keep the hot internal walls above this dew point.

11 Claims, 1 Drawing Sheet

PROCESS AND APPARATUS FOR COATING METAL SHEETS

FIELD OF THE INVENTION

The present invention relates to a process and a device for depositing and drying a protective or decorative coating on a continuously moving metal sheet.

BACKGROUND OF THE INVENTION

The technique of depositing and drying such a coating is commonly used on metal sheets on which the coating, containing components which may be metallic, organic or aqueous, is generally deposited in liquid form.

Among the many examples relating to this technique, mention may be made in particular of the application of paint. This contains organic or aqueous solvents and, after depositing the layer of paint on the sheet, the combination is heated so as to facilitate evaporation of the solvents and to allow the paint to cure. For safety reasons, and so as to bring the polluting emissions under control, the solvents thus evaporated are continuously extracted so as to be possibly incinerated. The sheet provided with its paint coating may be heated by various means, especially by blowing hot air or by using infrared heating or electromagnetic induction heating systems.

Electromagnetic induction heating has the advantage of heating the paint via the substrate (that is to say via the sheet), the heat flux propagating outwards, which facilitates evaporation of the solvents. On the other hand, this mode of heating has the characteristic of only heating the metal sheet, the atmosphere and the walls of the oven remaining relatively cool. Although this characteristic has the advantage of limiting thermal losses, it has, in particular, the drawback of causing recondensation of the evaporated solvents on the coolest parts of the walls of the oven, the temperature of which is generally less than the dew point of the solvents.

Furthermore, the circuits for water-cooling the coils of the electromagnetic induction heating device also constitute preferred condensation points. The condensates resulting are particularly irksome when they drop onto the coating freshly deposited on the sheet or onto the rollers for applying the coating in contact with it. As a result the coating is no longer uniform, which represents a defect in its appearance and possibly in its protection.

In order to alleviate these drawbacks, various solutions have been envisaged, in particular that consisting in limiting the recondensation of the solvents, for example by increasing the flow rate of air in the oven. However, experience shows that the solutions thus envisaged prove not to be very effective and are often incompatible with economic operation of the plant.

BRIEF DESCRIPTION OF THE INVENTION

The present invention therefore is intended to avoid such recondensation of the solvents and the principle which it employs consists, on the one hand, in raising the temperature of the atmosphere in the oven above the dew point of the solvents and, on the other hand, in separating the atmosphere from the cool points by means of a particular design of the tunnel of the oven.

In consequence, the present invention relates, in the first place, to a process for the protective or decorative coating of a continuously moving metal sheet, in which the sheet, after having received its coating, is heated by electromagnetic induction in a tunnel oven in order to evaporate the solvents and to cure the coating. The solvents are continuously extracted from the chamber of the oven. Injected into the oven is a gas chosen so that the internal walls of the oven are at a temperature greater than the dew point of the solvents. The oven is gastight and thermally insulated in order to keep the hot internal walls above this dew point.

The present invention also relates to a device for implementing the process as defined hereinabove, consisting of a tunnel oven through which the metal sheet passes continuously and which comprises at least one inductor for heating the sheet, this device being characterized in that the internal walls of the said tunnel oven are thermally insulated and gastight. The walls are transparent to the electromagnetic field and electrically non-conductive. Hot gas injection means, are provided at the inlet and at the outlet of the tunnel oven, and at least one point at which the solvent-laden atmosphere is exhausted from the oven.

BRIEF DESCRIPTION OF THE FIGURES

Other characteristics and advantages of the present invention will emerge from the description given hereinbelow with reference to the appended drawing which illustrates one example of embodiment thereof, which is devoid of any limiting character. In the drawing.

DETAILED DESCRIPTION OF THE INVENTION

Referring to the figures, it may be seen that the oven according to the present invention is in the form of a tunnel oven which includes an outer casing 4 and through which the metal sheet 1, which is to be provided with a protective or decorative coating, moves continuously. In the example illustrated in FIG. 1 and which has no limiting character, the tunnel oven includes two oven sections each provided with their inductor. This tunnel follows the line of passage of the oven, which may be vertical, horizontal (as illustrated in the figures) or at an angle. This oven is heated by electromagnetic induction and the cooled turns of the inductors are shown diagrammatically at 5. In a known manner, this induction heating, on the one hand, cures the coating deposited beforehand on the sheet 1 and, on the other hand, evaporates the solvents contained in the coating material.

Figure 1:
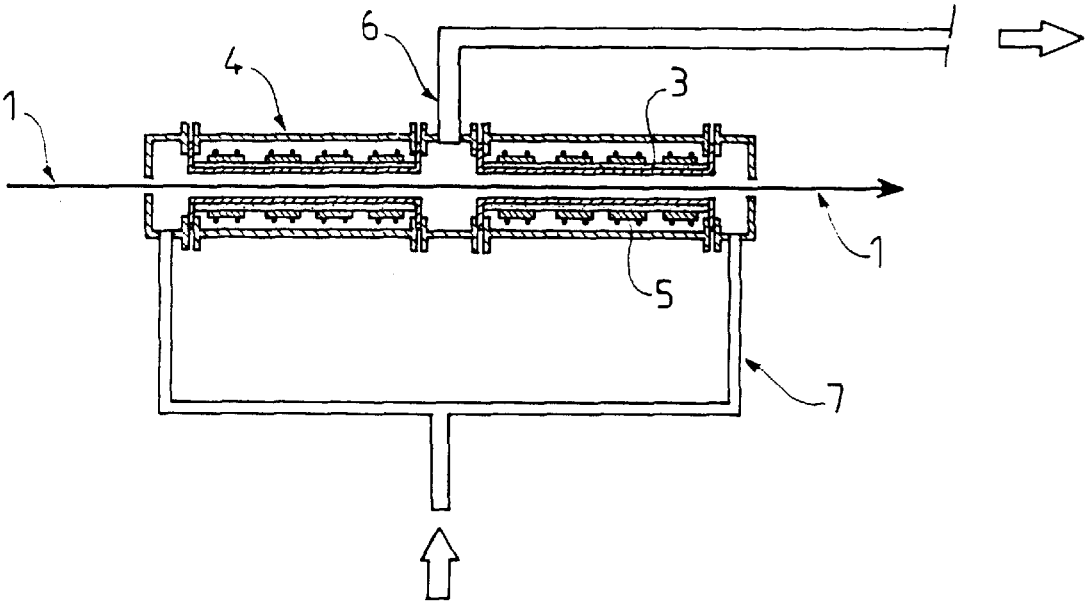
FIG. 1 is a diagrammatic view representing an oven according to the invention, in longitudinal axial section.
Figure 2:
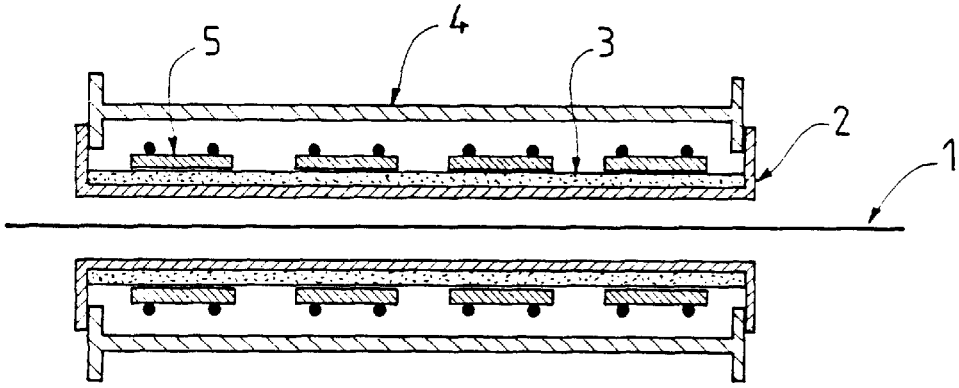
FIG. 2 is a view on a larger scale representing part of the oven illustrated in FIG. 1.

According to the present invention, a gas is injected into the tunnel 2 at a temperature chosen so that the internal walls of the oven are at a temperature greater than the dew point of the solvents. This temperature will depend on the characteristics of the solvents used and it may possibly be greater than the final temperature of the sheet. In general, it will be greater than 100° C. and, in the case of organic solvents, it will preferably be about 150° C. In order to ensure correct operation of the plant, the invention moreover provides a device for regulating the temperature of the injected gas. The gas thus injected will generally be air; however, a gas may be chosen which has any composition. In FIG. 1, the duct for injecting the preheated gas is shown at 7. In this figure, it may be seen that the gas is injected at the inlet and at the outlet of the oven.

The oven includes a system for exhausting the solvent-laden atmosphere from the oven. In FIG. 1, the duct for exhausting this atmosphere is shown at 6. The solvent-laden atmosphere may be extracted either at a single point or at several points. When the oven comprises several separate inductors, as illustrated in the non-limiting embodiment shown in FIG. 1, the extraction is preferably carried out between two inductors. Of course, the rate of extraction must remain in accordance with safety standards.

According to the invention, and insofar as solvent incineration means are provided, the solvents thus extracted are used to preheat the injected gas according to the process specified hereinabove.

The process of the invention also provides for rendering the oven gastight and thermally insulated so as to keep the internal walls hot. Thus, the oven is tight with respect to solvents, transparent to the magnetic field, and has both good thermal insulation and good mechanical properties. The system for joining the tunnel 2 to the induction coils 5 and for joining the various tunnel elements together is designed so as not to alter these properties appreciably.

In these figures, the thermal insulation which is provided according to the invention in each gastight tunnel section 2 has been shown diagrammatically at 3. This thermal insulation may be produced using any suitable known technique.

Apart from preventing the solvents from recondensing, which, as mentioned hereinabove, enables the quality of the coated product to be maintained, the invention provides other advantages, among which the following may especially be mentioned:

an improvement in the thermal efficiency of the oven when the hot gas injected into the oven is preheated by an incinerator, because of the reduction in losses via the walls of the inductor;

an improvement in the cleanliness of the oven, which decreases the frequency of maintenance operations associated with cleaning the oven.

An example of application of the invention will now be described, it being understood that this example in no way has any limiting character.

In this industrial application, a paint continuously applied to both sides of a steel sheet travelling horizontally is cured. The thickness of the sheet varies from 0.3 to 2.5 mm and its width from 700 to 1500 mm. Its speed is between 30 and 150 m per minute and the throughput of metal may be up to 60 tons per hour.

In one case of a particular size, a sheet 0.8 mm in thickness and 1250 mm in width, travelling at a speed of 80 m per minute, is heated to approximately 240° C. The oven, composed of three inductors, has a total length of approximately 11 m.

The conditions for implementing the process of the invention are the following:

hot air is injected at the inlet and at the outlet of the oven. This air, produced by the incinerator, is diluted with fresh air and injected at a temperature of approximately 150° C.;

the solvent-laden air is extracted at a single point, lying between the first and second inductors. The maximum output is 25,000 $m^3$ per hour for 300 liters of solvents deposited per hour;

the gastight tunnel is composed of three section, separated by two ducts made of aluminium or another non-magnetic material, each section corresponding to one inductor. The tunnel/duct assemblies are fixed together in a gastight manner by means of flanges.

Of course, it remains the case that the present invention is not limited to the embodiment and implementation examples, or to the embodiment example, which are described and mentioned hereinabove, but it encompasses all variants thereof. In particular, it will be noted that it does not matter whether the line of passage of the sheet is vertical, at an angle or horizontal.

We claim:

1. A method for curing a protective or decorative coating on a continuously moving metal sheet comprising the steps:

displacing a length of the sheet along a chamber path in an oven, the chamber being enclosed by gas tight walled sections that are thermally insulated;

energizing a source of induction heating that is located within the chamber;

subjecting the length of sheet to induction heating for achieving a temperature sufficiently high to evaporate solvents in the coating and cause its curing;

continuously extracting the evaporated solvents from the chamber;

introducing hot air into the chamber at a temperature greater than the dew point of the solvent;

wherein the walls of the chamber remain at a temperature above the dew point;

thereby preventing condensation of the solvents on surfaces of chamber walls.

2. The method set forth in claim 1 together with the steps:

subjecting the extracted solvent to incineration thereby producing heat; and subjecting the air, prior to its introduction to the chamber, to the heat produced by the incineration.

3. Process according to claim 1, wherein the solvents are extracted at a single point.

4. Process according to claim 1, wherein the solvents are extracted at several points.

5. A tunnel oven for curing a protective or decorative coating on a continuously moving metal sheet comprising:

a chamber in the oven through which the sheet passes for processing;

the chamber being enclosed by gas tight walled sections that are thermally insulated;

induction heating means heating a length of sheet in the chamber for achieving a temperature sufficiently high to evaporate solvents in the coating and cause its curing;

the walled sections being transparent to an electromagnetic field generated by the induction means as well as being electrically non-conductive;

means for continuously extracting the evaporated solvents from the chamber;

means for introducing hot air into an inlet and an outlet of the chamber, at a temperature greater than the dew point of the solvent;

wherein the walls of the chamber remain at a temperature above the dew point.

6. The oven of claim 5 wherein the induction means comprise at least two inductors; and the solvents are extracted between the two inductors.

7. The oven of claim 5 together with means for incinerating the extracted solvent thereby producing heat; and means for heating the air, prior to its introduction to the chamber, by the heat produced from incineration.

8. Device according to claim 5, further including a system for regulating the temperature of the hot air injected into the oven.

9. Device according to claim 5, wherein passage of the sheet is vertical.

10. Device according to claim 5, wherein passage of said sheet is horizontal.

11. Device according to claim 5, wherein passage of said sheet is oblique.

* * * * *